US007358925B2

(12) United States Patent
Rosenberg et al.

(10) Patent No.: US 7,358,925 B2
(45) Date of Patent: Apr. 15, 2008

(54) HIGHLY-INTEGRATED HEADSET

(75) Inventors: Johan Anton Eduard Rosenberg, Dwingeloo (NL); Theodoor Rene Maria Hin, Emmen (NL); Gerrit Johannes Willem Sampimon, Erm (NL)

(73) Assignee: Sony Ericsson Mobile Communications AB (SE)

( * ) Notice: Subject to any disclaimer, the term of this patent is extended or adjusted under 35 U.S.C. 154(b) by 0 days.

(21) Appl. No.: 11/243,814

(22) Filed: Oct. 5, 2005

(65) Prior Publication Data

US 2006/0097930 A1 May 11, 2006

Related U.S. Application Data

(60) Provisional application No. 60/620,651, filed on Oct. 20, 2004.

(30) Foreign Application Priority Data

Oct. 7, 2004 (EP) ..... 04023951

(51) Int. Cl.
*H01Q 9/30* (2006.01)

(52) U.S. Cl. ..... 343/900; 343/702

(58) Field of Classification Search ..... 343/900, 343/702, 700 MS, 895, 846, 848, 873; 381/380
See application file for complete search history.

(56) References Cited

U.S. PATENT DOCUMENTS

| | | | | |
|---|---|---|---|---|
| 5,495,260 | A * | 2/1996 | Couture | 343/795 |
| 6,342,859 | B1 | 1/2002 | Kurz et al. | 343/702 |
| 6,353,443 | B1 * | 3/2002 | Ying | 715/702 |
| 6,366,259 | B1 * | 4/2002 | Pruett et al. | 343/853 |
| 6,396,456 | B1 * | 5/2002 | Chiang et al. | 343/795 |
| 6,486,836 | B1 * | 11/2002 | Hill | 343/702 |
| 6,661,380 | B1 * | 12/2003 | Bancroft et al. | 343/700 MS |
| 6,850,197 | B2 * | 2/2005 | Paun | 343/702 |
| 2003/0157972 | A1 | 8/2003 | Bae | 455/568 |
| 2004/0062412 | A1 | 4/2004 | Nassimi | 381/380 |
| 2006/0120546 | A1 * | 6/2006 | Tanaka et al. | 381/315 |

FOREIGN PATENT DOCUMENTS

| | | |
|---|---|---|
| EP | 1 443 591 | 8/2004 |
| WO | WO 95/31048 A1 | 11/1995 |

OTHER PUBLICATIONS

European Search Report; EP 04 02 3951; Nov. 17, 2004.
Communication pursuant to Article 96(2) EPC, EP 04 023 951.9, Nov. 15, 2007.

* cited by examiner

*Primary Examiner*—Huedung Mancuso
(74) *Attorney, Agent, or Firm*—Myers Bigel Sibley & Sajovec, P.A.

(57) ABSTRACT

A wireless communication device includes a coupling apparatus, an antenna, an elongated printed circuit board, a battery, a speaker, and a microphone. The coupling apparatus is configured to acoustically couple the wireless communication device to a user's ear. The antenna is configured to transmit and receive communication signals. The elongated printed circuit board includes radio circuits and a ground plane for the antenna. The battery is configured to power the radio circuits. The speaker and the microphone are connected to the printed circuit board. The antenna includes a monopole antenna printed as a meandering trace on the printed circuit board. The ground plane forms a first part of the printed circuit board and the meandered trace forms a second part of the printed circuit board. The battery is mounted on the printed circuit board.

9 Claims, 4 Drawing Sheets

HIGHLY-INTEGRATED HEADSET

CROSS-REFERENCE TO RELATED APPLICATION

This application claims the priority of European Patent Application No. 04023951.9, filed on Oct. 7, 2004, in the European Patent Office, and to U.S. Provisional Patent Application No. 60/620,651, filed on Oct. 20, 2004 the disclosures of which are incorporated herein in their entirety by reference.

FIELD OF THE INVENTION

The present invention relates to headsets and other devices that can be placed near the head of a user to provide audible coupling between the user and a wireless communication device such as a telephone, an announcement device, two-way radio equipment and/or other communication systems.

BACKGROUND

Wireless headset systems are used for hands free talking via a mobile terminal or a base station. In automobiles, for example, headsets allow the use of mobile terminals without the necessity to hold the mobile terminal to the head while being in a conversation and thus, the driver of a vehicle may use both hands to control the automobile.

Most conventional wireless headsets are held on the head by a head band or a preshaped rigid supporting portion (ear hook), which is to be mounted behind the ear. A speaker portion is placed in the ear orifice, and a rigid microphone supporting boom extents towards the mouth. Microphone and speaker are connected to a transceiver for transmitting/receiving a voice signal via an antenna. The communication can be based on a communication protocol, such as the Bluetooth™, the WLAN (Wireless Local Area Network), the UMTS (Universal Mobile Telecommunication Systems), or the GSM (Global Systems for Mobile communication) protocol.

Nowadays, headsets have to be as small as possible, and nevertheless functional. In particular, high power efficiency, good acoustical and antenna performance are desired. Thereby, the antenna design is a main factor for the size of the headset, especially in the case when the antenna has to achieve a sufficient bandwidth to fulfill the requirements of the above communication protocols. Such antennas require a certain ground plane size to achieve the desired bandwidth. Generally, small antennas have a lower efficiency than big antennas, wherein a low efficiency wastes battery power.

A headset having a built-in wideband antenna which requires a small ground plane is described in EP1416585A1. In this design, the antenna arrangement has a three-dimensional structure, like a rectangular box, wherein one of the planes is the printed circuit board (PCB), on which the grounding layer and the radio circuits are provided. Although said document suggests to place components such as batteries inside the antenna structure, there is a lot of space that cannot be used for any other purpose. However, the ideal solution has no unused space (air) inside the product.

SUMMARY OF EMBODIMENTS OF THE INVENTION

According to some embodiments of the present invention a wireless communication device comprises a coupling apparatus that is configured to acoustically couple the wireless communication device to user's ear, an antenna configured to transmit and receive communication signals, an elongated printed circuit board including a ground plane for the antenna and radio circuits, a battery configured to power the radio circuits, a speaker and a microphone connected to the printed circuit board. The antenna may be a monopole antenna printed as a meandering trace on the printed circuit board. The ground plane may form a first part of the printed circuit board and the meandered trace may form a second part of the printed circuit board. The battery may be mounted on said printed circuit board.

Accordingly, in some embodiments of the present invention, all parts of the wireless communication device can be mounted against each other without disturbing each other which enables a high integration level. Further, manufacturing may be simplified because the antenna is integral to the printed circuit board instead of a folded metal piece which is difficult to handle/arrange exactly, which makes it vulnerable to mistuning.

In accordance with a further embodiment of the present invention, the ground plane and the meandered trace each have a length of at least a quarter of the wavelength of the communication signals.

In a further embodiment of the present invention, the battery extends along the first part of the printed circuit board.

The battery may be positioned between the circuit board and a user's head when the wireless communication device is coupled to the user's ear.

In a further embodiment of the present invention, the battery is positioned between the microphone and the speaker.

In a further embodiment of the present invention, the microphone is positioned in front of the battery along the second part of the printed circuit board.

In a further embodiment of the present invention, the microphone is acoustically connected to acoustic sources outside the communication device through an air tube in the second part of the printed circuit board.

In a further embodiment of the present invention, the coupling apparatus includes an earplug enclosing the speaker configured to be inserted at least partially into a user's ear.

With some embodiments of the present invention, the speaker is placed in a separate compartment apart from the microphone and/or the acoustic distance between speaker and microphone is increased by the air tube, which may reduce background noise and avoid feedback between the speaker and the microphone. The speaker and microphone may thereby be mounted closer to each other, which may reduce the size of the wireless communication device and my avoid the need for a digital signal processor (DSP) which would consume space and power.

In some embodiments, the distance between antenna and the user's head may be increased by positioning the battery between the circuit board and the user's head, and/or the antenna may be placed in the part of the wireless communication device opposite the earplug at a furthest position from the head.

Thus, some embodiments of the wireless communication device may provide high power efficiency, good acoustical and antenna performance, and/or an high integration level.

DETAILED DESCRIPTION OF EMBODIMENTS OF THE INVENTION

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art.

It will be understood that, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps and/or functions without precluding one or more unstated elements, steps and/or functions. The term "and/or" includes any and all combinations of one or more of the associated listed items.

It will also be understood that when an element is referred to as being "connected" to another element, it can be directly connected to the other element or intervening elements may be present. In contrast, when an element is referred to as being "directly connected" to another element, there are no intervening elements present. It will also be understood that the sizes and relative orientations of the illustrated elements are not shown to scale, and in some instances they have been exaggerated for purposes of explanation. Like numbers refer to like elements throughout.

Embodiments according to the present invention are described with reference to block diagrams and/or operational illustrations of methods and wireless communication devices. It is to be understood that each block of the block diagrams and/or operational illustrations, and combinations of blocks in the block diagrams and/or operational illustrations, can be implemented by radio frequency, analog and/or digital hardware, and/or computer program instructions. Computer program instructions may be provided to a processor circuit of a general purpose computer, special purpose computer, ASIC, and/or other programmable data processing apparatus, such that the instructions, which execute via the processor of the computer and/or other programmable data processing apparatus, create means for implementing the functions/acts specified in the block diagrams and/or operational block or blocks.

Figure 1:
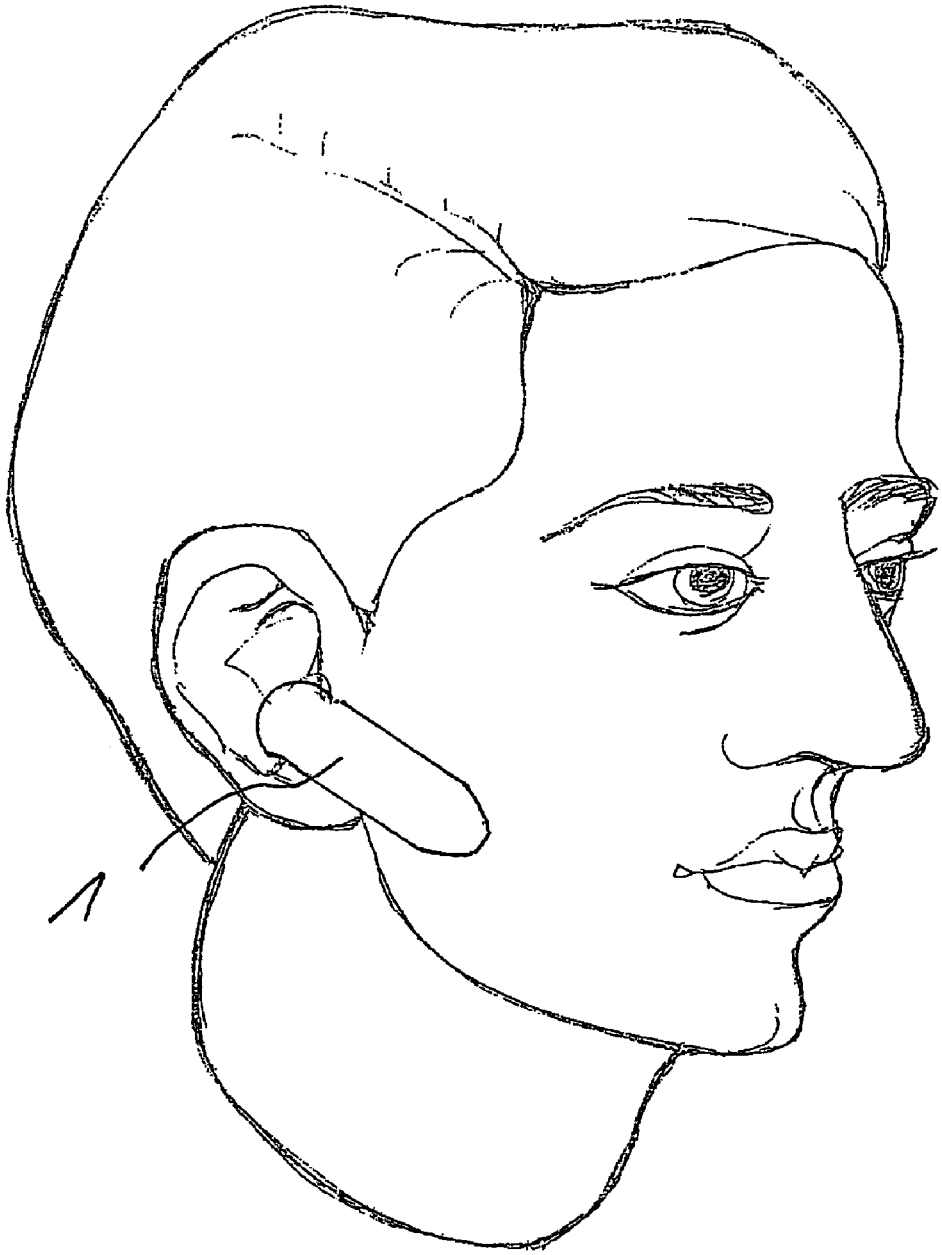
FIG. 1 shows a small communication device according to the present invention embodied as a headset.

FIG. 1 shows a small communication device according to the present invention, which is a headset 1 adapted for wireless communication with another communication device, which may be stationary or portable (not shown). The device may be a headset for short length high frequency wireless communication like Bluetooth™.

Figure 2:
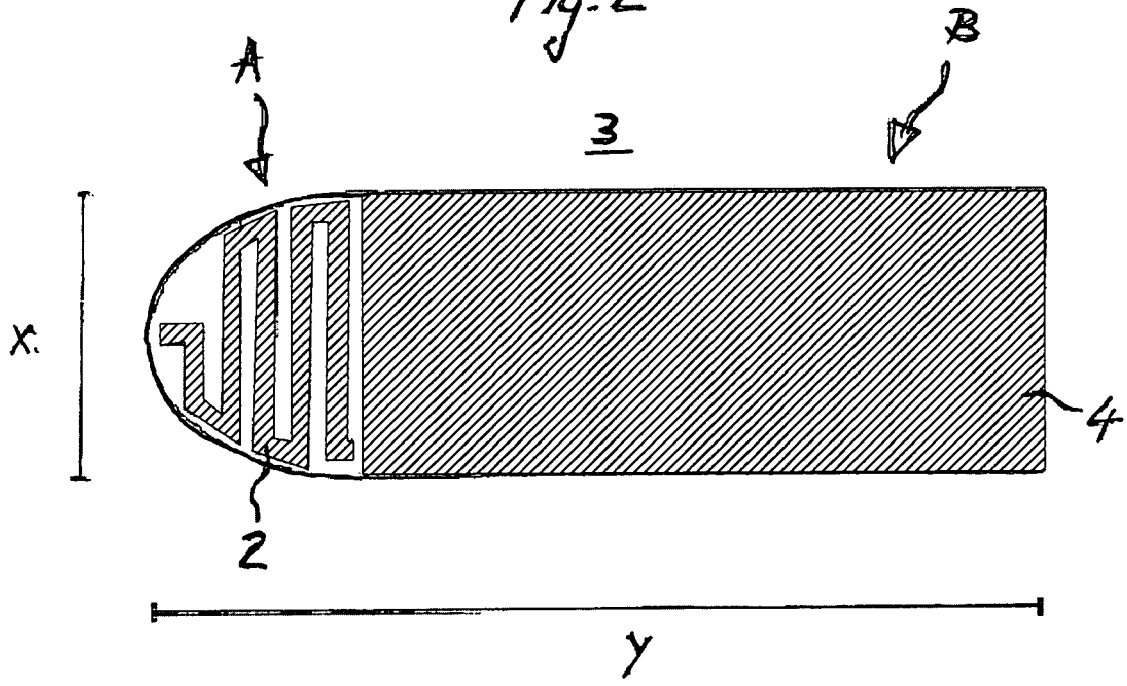
FIG. 2 shows the antenna structure on the printed circuit board of the headset shown in FIG. 1.

As shown in FIG. 2 (top view) the antenna is a meandered monopole on a printed circuit board 3 and built with a ground plane 4 and a trace 2, wherein both, the ground plane 4 and the meandered trace 2 are of a conductive material and have an electrical length of approximately a quarter of the wavelength or significantly longer than ¼ wavelength. The shape of the printed circuit board 3 can be adapted to the design of the headset 1, so that there is a high flexibility in the visual design of the headset 1. The printed circuit board 3 shown in FIG. 2 is an elongated printed circuit board 3, wherein the side x is smaller than the side y (x>>y). The printed circuit board 3 comprises a square part B which includes ground plane 4 and a rounded part A which includes the meandered trace 2. Generally, the printed circuit board 3 can be made out of all the known PCB materials and any number of layers. The preferred PCB material is a standard FR4 (Epoxyd) substrate material, which is a low cost material.

The antenna 2, 4 is very easy and cheap to manufacture and can be tuned simply by slight changes in length, wherein the length of the trace 2 mainly determines the resonant frequency of the antenna 2, 4. But like any other antenna types, the gain of a quarterwave monopole antenna will vary if parameters in the surroundings like case/box materials (not shown), distance to the ground plane 4, the size of the ground plane 4, width and thickness of the trace 2 are varied. If any of these parameters are changed, a retuning of the monopole PCB trace 2 length may be necessary for optimum performance in each application. The antenna can have any shape and can follow any designed board contour, wherein the antenna can be distributed also on both sides of the printed circuit board 3.

Figure 3:
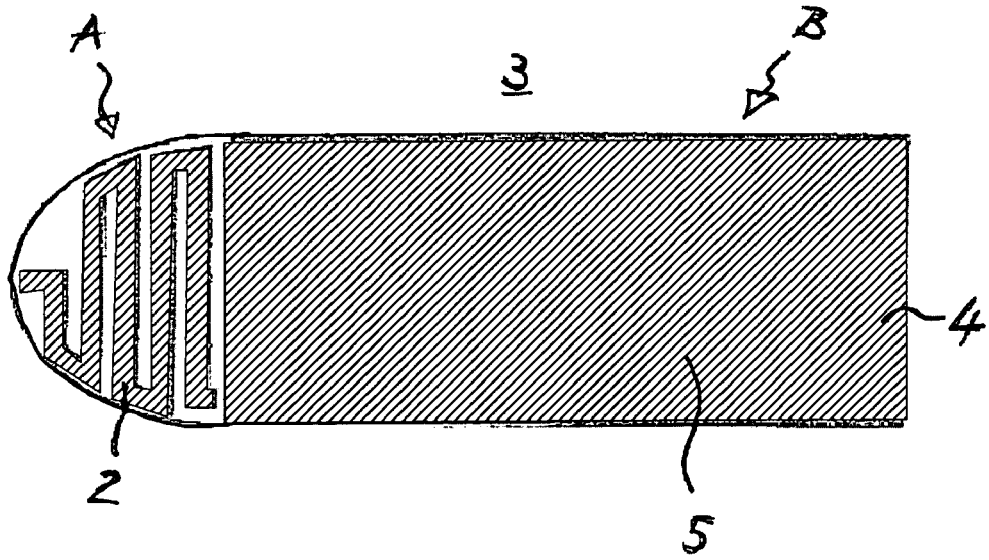
FIG. 3 shows the antenna structure and the radio circuits on the printed circuit board of the headset shown in FIG. 1, FIG. 4 schematically shows, in a side view, the arrangement of the components of the headset according to the present invention.

FIG. 3 shows an example of how the printed antenna 2, 4 is combined with the electronic components 5 on the same printed circuit board 3. As shown in FIG. 3, for small size, easy fabrication and low cost of the headset 1, in the region of the ground plane 4, the electronic components 5 such as radio module /RF (radio frequency) circuits and MMI (Man Machine Interface) are implemented on the same printed circuit board 3 as the antenna 2, 4, wherein the ground plane 4 can be a separate conductive layer on the printed circuit board 3 or the ground of the printed RF circuits.

Figure 4:
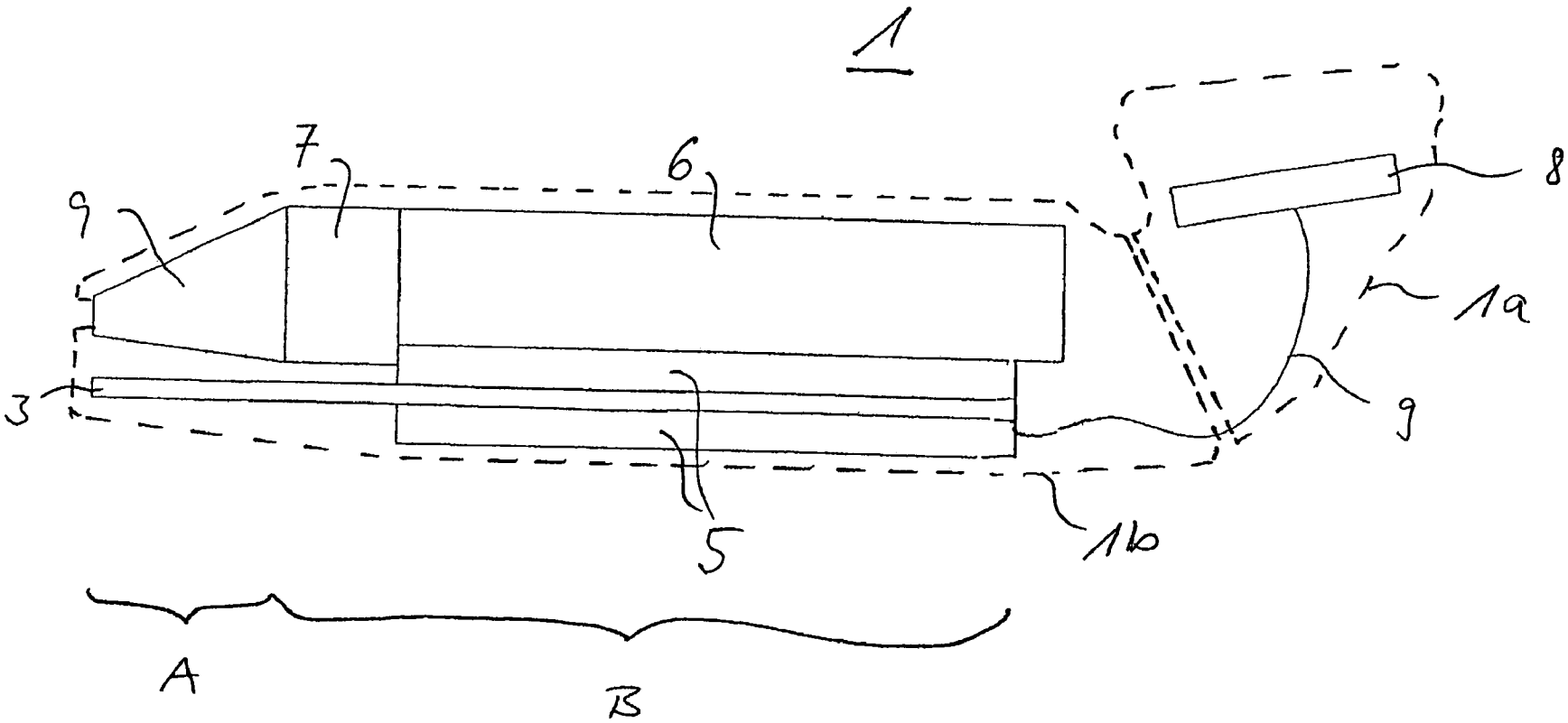

FIG. 4 schematically shows, in a side view, an arrangement of the components in the headset 1 according to the present invention, wherein A indicates the region of the meandered trace 2 and B indicates the region of the ground plane 4 (cf. FIGS. 3 and 4). As shown in FIG. 4, electronic components 5 are implemented on both sides of the printed circuit board 3. A battery 6 is mounted on the top of the printed circuit board 3, and extends along the electronic components 5 of the printed circuit board 3. The preferred battery type is a lithium polymer battery which is very light and therefore the most suitable candidate, if the headset 1 does not have any bulky ear hook but is carried in the ear (in ear wearing) as shown in FIG. 1. A microphone 7 is positioned above the printed circuit board 3 in the region B of the ground plane 4 (not shown), and adjoins the battery 6. A speaker 8 is connected to the printed circuit board 4 via a line 9 and is arranged so that the battery 6 is between microphone 7 and speaker 8. The acoustic distance between speaker 8 and microphone 7 is increased by the air tube 9 which is mounted on the microphone 7 and positioned above the printed circuit board 3 in the region A of the meandered trace 2 (not shown). For decoupling the loudspeaker and microphone acoustically, as shown in FIG. 4 (dotted line), the speaker 8 is placed in a separate enclosure 1*a* so that the microphone 7 and the speaker 8 are housed in separate enclosures 1*b* and 1*a*, respectively.

Figure 5:
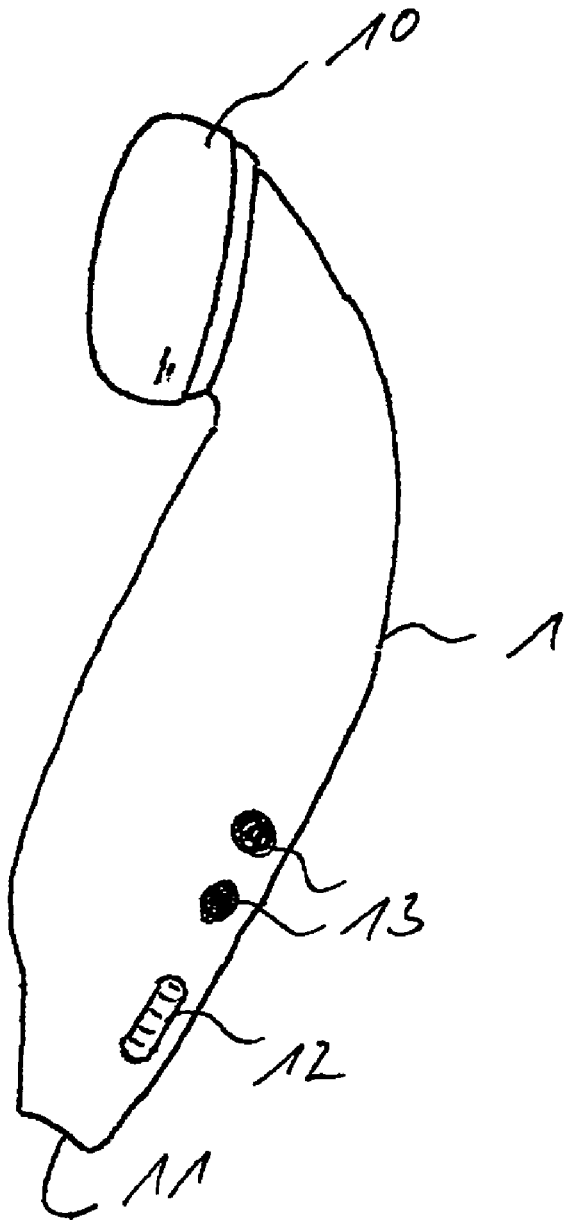
FIG. 5 shows a side view of the headset shown in FIG. 1.

As shown in FIG. 5, the headset 1 comprises an earplug 10 to be inserted into the ear of a user in which the speaker 8 is housed (not shown). An opening 11 is in the lower end of the headset 1 and leads the sound via the air tube 9 to the microphone 7 (not shown). In this way, when the speaker is inserted into the ear of a user (inner concha), the emission of sound from the speaker 8 to the outside is lowered and thus, in combination with the extension of the acoustic distance between speaker 8 and microphone 7 via the air tube 9, the acoustical echo between speaker 8 and microphone 7 is further is lowered. This allows, for a reduction of the size of the headset 1, to shorten the physical distance between speaker 8 and microphone 7 and to let a DSP away. Further, the position of the speaker 8 also cause a very low loss of sound pressure towards the ear. This means, due to the high coupling between the speaker 8 and the ear, the speaker 8 has only to produce a small sound pressure which further reduces said echo and the power consumption, and which allows the use of an even smaller speaker 8. The headset 1 further comprises a volume control 12 for the speaker 8 and control keys 13.

One of the disadvantages associated with conventional headsets is poor antenna transmission and reception, which is mainly due to the user's head which blocks or obstructs the emission of electromagnetic energy via the antenna. This is especially true when the antenna has an antenna element that provides an emission pattern that is radiated from a focused point of radiation. With the present invention, when the headset 1 is coupled to the ear of a user via the earplug 10, the battery 6 is positioned between the circuit board 3 and the head of the user. This guarantees a predetermined distance between the antenna 2, 4 and the head of the user and thus, a good antenna efficiency while having a simple construction.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A wireless communication device comprising:

an antenna that is configured to transmit and receive communication signals;

an elongated printed circuit board comprising radio circuits and a ground plane for said antenna;

a battery configured to power said radio circuits;

a speaker connected to said printed circuit board;

a coupling apparatus that is configured to be coupled to a user's ear to direct sound from the speaker to the user's ear;

a microphone connected to said printed circuit board; and an air tube which is mounted on the microphone and positioned above the printed circuit board, wherein:

said antenna comprises a monopole antenna printed as a meandering trace on said printed circuit board;

said ground plane forms a first part of said printed circuit board and said meandering trace forms a second part of said printed circuit board;

said battery is connected to said printed circuit board, and said battery is positioned between the printed circuit board and a user's head when the coupling apparatus is coupled to the user's ear and said battery is positioned between said microphone and said speaker; and said microphone and said speaker are housed in separate enclosures.

2. A wireless communication device according to claim 1, wherein said battery extends along said first part of the printed circuit board.

3. A wireless communication device according to claim 1, wherein said microphone is positioned in front of the battery along said second part of the printed circuit board.

4. A wireless communication device according to claim 2, wherein said microphone is positioned in front of the battery along said second part of the printed circuit board.

5. A wireless communication device according to claim 2, wherein said battery is positioned between said microphone and said speaker.

6. A wireless communication device according to claim 1, further comprising an acoustic air tube in the second part of the printed circuit board that is configured to acoustically couple said microphone to acoustic sources outside the commnunication device.

7. A wireless communication device according to claim 4, further comprising an acoustic air tube in the second part of the printed circuit board that is configured to acoustically couple said microphone to acoustic sources outside the communication device.

8. A wireless communication device according to claim 1, wherein said coupling apparatus comprises an earplug enclosing the speaker and configured to be inserted at least partially into a user's ear.

9. A wireless communication device according to claim 1, wherein said ground plane and said meandered trace each have a length of at least a quarter of the wavelength of the communication signals.

* * * * *